United States Patent [19]

Mikhail

[11] Patent Number: 5,076,068

[45] Date of Patent: Dec. 31, 1991

[54] COOLING DEVICE FOR A PLURALITY OF COOLANT CIRCUITS

[75] Inventor: Noya Mikhail, Weissenbrunn, Fed. Rep. of Germany

[73] Assignee: KKW Kulmbacher Klimageräte-Werk GmbH, Kulmbach, Fed. Rep. of Germany

[21] Appl. No.: 552,752

[22] Filed: Jul. 16, 1990

[30] Foreign Application Priority Data

Jul. 31, 1989 [EP] European Pat. Off. ..... 89114116.0

[51] Int. Cl.[5] ..... F25B 1/00

[52] U.S. Cl. ..... 62/215; 62/196.4; 62/201

[58] Field of Search ..... 62/196.4, 201, 216, 62/215; 236/78 B; 374/116, 110

[56] References Cited

U.S. PATENT DOCUMENTS

| | | | |
|---|---|---|---|
| 2,022,771 | 12/1935 | Killen | 62/4 |
| 2,136,813 | 11/1938 | Dolison | 62/7 |
| 2,598,751 | 6/1952 | Berkowitz et al. | 62/201 |
| 2,646,667 | 7/1953 | Kormer | 62/116 |
| 3,481,151 | 12/1969 | Seeley | 62/196.4 |
| 3,675,441 | 7/1972 | Perez | 62/278 |
| 3,859,812 | 1/1975 | Pavlak | 62/99 |
| 4,060,997 | 12/1977 | Shultz et al. | 62/180 |

FOREIGN PATENT DOCUMENTS

| | | |
|---|---|---|
| 3101138 | 1/1981 | Fed. Rep. of Germany . |
| 8407854 | 3/1984 | Fed. Rep. of Germany . |
| 2114419 | 6/1972 | France . |
| 2625871 | 1/1988 | France . |
| 202328 | 4/1939 | Switzerland . |
| 223393 | 12/1942 | Switzerland . |
| 265303 | 2/1950 | Switzerland . |

*Primary Examiner*—William E. Wayner
*Attorney, Agent, or Firm*—Spencer & Frank

[57] ABSTRACT

A cooling device for a plurality of coolant circuits for equipment to be cooled, also those having greatly differing cooling power requirements, whose evaporator is disposed in a refrigerant circuit including a compressor, a condenser and an expansion valve. A thermostat switches on the compressor, dependent on the temperature of the coolant in the cooling circuits as measured upstream of the evaporator, if the switching temperature of the coolant is reached and switches off the compressor if the switching temperature is no longer reached. A bypass valve in a bypass conduit between points of connection of the refrigerant conduit downstream of the compressor and downstream of the expansion valve, is controlled by a pressure sensor provided in the refrigerant circuit and disposed upstream of the compressor so that, if there is a minimum pressure in the evaporator, which pressure must always be maintained for reasons of safety in order to prevent the coolant from freezing in the evaporator, the bypass valve is opened, and if there is a certain pressure in the evaporator above the minimum pressure the bypass valve is closed.

4 Claims, 2 Drawing Sheets

COOLING DEVICE FOR A PLURALITY OF COOLANT CIRCUITS

BACKGROUND OF THE INVENTION

The invention relates to a cooling device for a plurality of coolant circuits for equipment to be cooled which pass through an evaporator, also those having greatly differing requirements for cooling power, as defined in detail in claim 1.

Cooling devices for changing volume flow or cooling power are made available in practice only at relatively high cost. The realization becomes more difficult as the number of coolant circuits that must be operated increases, particularly if cooling power changes. If the cooling device is designed for high performance, there is a danger at low power that freezing may occur.

SUMMARY OF THE INVENTION

It is an object of the invention to provide a cooling device whose cooling power depends in a simple manner on the coolant throughput in secondary coolant circuits. The solution to the above described problems is a cooling device as defined in claim 1. The evaporator 1 is disposed in a refrigerant circuit 5 including other components, such as a compressor 6, condenser 7 and expansion valve 8. Depending on the temperature of the coolant in the secondary cooling circuits (2,3) as measured upstream of the evaporator 1, a thermostat 11 switches on the compressor 6 when the coolant reaches a switching temperature. The compressor 6 is switched off when the switching temperature is no longer reached. A pressure sensor 14 in the refrigerant conduit 5 controls a bypass valve 12 in a bypass conduit 13 between the points of connection of the refrigerant circuit 5 downstream of the compressor 6, on the one hand, and downstream of the expansion valve 8, on the other hand. The pressure sensor 14 is disposed upstream of the compressor 6 when viewed in the direction of flow of the refrigerant. It controls the bypass valve 12 in such a manner that the valve is opened when a minimum pressure exists in the evaporator 1. This is the pressure which, for reasons of safety, must always be maintained in the evaporator 1 in order to prevent the coolant—in one of the secondary circuits (2,3)—from freezing in the evaporator 1. At a certain pressure within the evaporator 1 above the minimum pressure, the bypass valve 12 is closed. With this special control of the compressor 6, the cooling power of the cooling device adapts itself to the throughput of different quantities and to different cooling performances in the secondary coolant circuits (2,3), with the special bypass control preventing freezing of the coolant in the compressor 6 so that full performance adaptation is possible in an appropriate manner.

The adaptation of the refrigeration performance of the cooling device goes so far that the coolant in the individual coolant circuits (2,3) may also be stationary, that is, the respective coolant circuit need not generate any cooling power.

If there are two coolant circuits (2,3), the evaporator 1 may be provided in a particularly simple manner with a coaxial structure composed of an outer pipe, a middle pipe and an inner pipe, so that three coaxially arranged annular chambers are formed. The outer and inner annular chambers may each be traversed by a coolant in one direction, with the refrigerant in the middle annular chamber being conducted in the opposite direction to the flow of the coolant. Such a coaxial pipe structure is illustrated in FIG. 2 and is known per se (DE-GM 84 07 854).

According to another embodiment of the cooling device according to the invention, the thermostat 11 is equipped with a temperature sensor 15 which is passed by the conduits (2,3) of all coolant circuits. Thus, the coolant temperature is averaged and simple control becomes possible. Because using individual sensors at the respective coolant conduits would not result in a change in the signal for a stationary coolant, it would not otherwise be possible to effect an appropriate regulation by simple means. Water may be employed as the coolant in the secondary coolant circuits (2,3).

The invention will now be described in greater detail with reference to an embodiment thereof for two coolant circuits and one refrigerant circuit as indicated roughly schematically in the drawing figure.

DETAILED DESCRIPTION OF THE PREFERRED EMBODIMENT(S)

Figure 1:
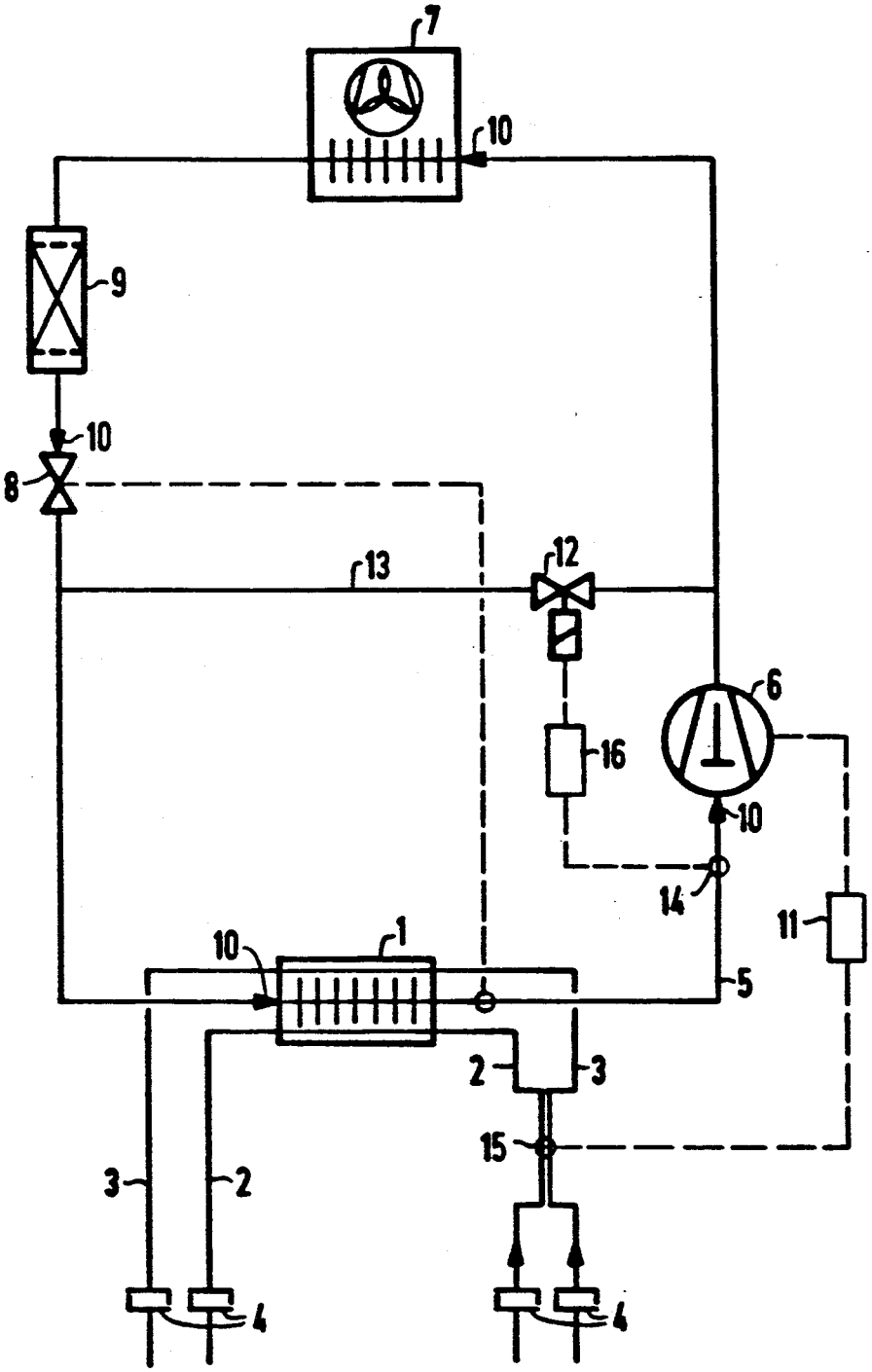
FIG. 1 illustrates the cooling device according to an embodiment of the invention.

The cooling device in the illustrated embodiment includes two coolant circuits 2 and 3 which pass through an evaporator 1. Equipment to be cooled may be connected at connection sockets 4 which complete each coolant circuit. In addition to evaporator 1, refrigerant circuit 5 includes a compressor 6, a condenser 7 and an expansion valve 8. The throughput of expansion valve 8 is controlled in the conventional manner by means of a temperature control or an additional pressure control so that just that amount of refrigerant is permitted to pass which can still be almost completely evaporated in evaporator 1. Additionally, a dryer may be connected in a known manner upstream of expansion valve 8. The direction of flow is indicated by flow arrows 10.

It is significant that, when the switching temperature of the coolant is reached, a thermostat 11 switches on compressor 6 dependent on the coolant temperature in the coolant circuits (2,3) as measured upstream of evaporator 1, and switches the compressor 6 off if the switching temperature is no longer reached. It is further significant that a bypass valve 12 in a bypass circuit 13, between the points of connection of the refrigerant circuit 5 downstream of compressor 6, on the one hand, and downstream of expansion valve 8, on the other hand, is controlled by a pressure sensor 14 in the refrigerant circuit 5. This pressure sensor 14 is disposed upstream of compressor 6 and effects the control as follows:

If there is a minimum pressure in evaporator 1, which, for reasons of safety, must always be maintained in order to prevent the coolant from freezing in the evaporator 1, bypass valve 12 is opened. At a certain pressure in the evaporator 1 above the minimum pressure, bypass valve 12 is closed. Otherwise, the coolant in the evaporator 1 could freeze particularly if the coolant in one coolant circuit (2,3) were to stop moving. In the cooling device according to the invention, the required cooling power may decrease to such an extent that some coolant circuits (2,3) are stopped. In the illustrated embodiment, one of two coolant circuits (2,3) can be switched off without adversely affecting operation of the cooling device. Pressure sensor 14 is a functional component of a pressostat 16.

Figure 2:
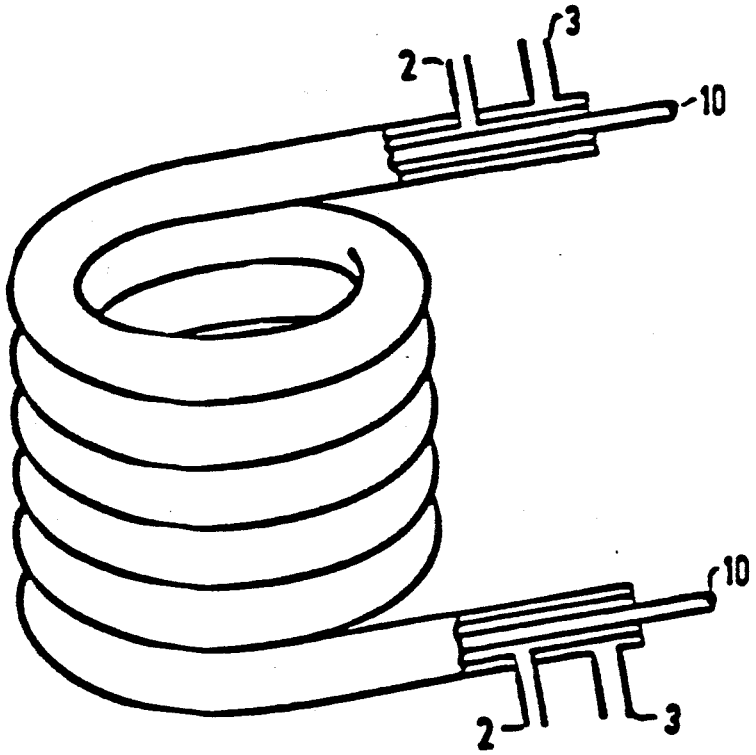
FIG. 2 illustrates the coaxial structure of an evaporator.

In two coolant circuits 2 and 3, evaporator 1 may have a coaxial pipe structure composed of an outer pipe, a middle pipe and an inner pipe (see FIG. 2). Of the resulting coaxially arranged annular chambers, the outer annular chamber may be made available to coolant circuit 3 and the inner annular chamber to coolant circuit 2 for example. The refrigerant would then flow through the middle annular chamber. The outer annular chamber may advantageously be made available requiring a coolant circuit for greater cooling power than the coolant circuits connected to the inner annular chamber, since the outer annular chamber has larger heat-exchanging surfaces.

Advantageously, the conduits of all coolant circuits are brought past the temperature sensor 15 of thermostat 11. Temperature sensor 15 is a functional component of thermostat 11. In the illustrated embodiment, the two conduits of coolant circuits 2 and 3 are brought past the temperature sensor 15. Even if the coolant in one of the coolant circuits (2,3) stops moving because no cooling at all is required in this circuit, temperature sensor 15 determines in a simple manner an easily evaluated signal. For example, if coolant circuit 3 is configured for a cooling power of 500 W and coolant circuit 2 for 300 W, the cooling power made available by refrigerant circuit 5 can be stepped down to such a degree (if the coolant in coolant circuit 3 has stopped moving) as the temperature drops at temperature sensor 15 due to the reduced demand for refrigeration. The coolant in coolant circuits 2 and 3 may be water.

A cooling device which compensates for great differences in cooling power requirements is suitable, for example, for litholapaxy equipment.

I claim:

1. A cooling device for use with a plurality of coolant circuits conducted through an evaporator, and for use with those having greatly differing cooling power requirements, said evaporator being disposed in a refrigerant circuit including a compressor, a condenser and an expansion valve, said cooling device comprising:

a thermostat for switching on said compressor responsive to the temperature of the coolants in said plurality of cooling circuits as measured upstream of said evaporator when a switching temperature is reached and for switching off said compressor when the switching temperature is no longer reached; and a bypass valve in a bypass circuit connected across said refrigerant circuit downstream of said compressor and downstream of said expansion valve, said bypass valve being controlled by a pressure sensor provided in said refrigerant circuit and disposed upstream of said compressor, so that, when there is a minimum pressure in said evaporator, which pressure should always be maintained for reasons of safety in order to prevent said coolant from freezing in said evaporator, said bypass valve is opened, and when there is a certain pressure in said evaporator above said minimum pressure, said bypass valve is closed.

2. A cooling device according to claim 1, wherein said plurality of coolant circuits is composed of two coolant circuits, and said evaporator has a coaxial pipe structure comprising an outer pipe, a middle pipe and an inner pipe forming three coaxially arranged annular chambers, said coolant flowing in one direction through the outer and inner annular chambers, and said refrigerant flowing in the opposite direction through the middle annular chamber.

3. A cooling device according to claim 1, wherein said thermostat includes a temperature sensor which is passed by conduits of all of said plurality of coolant circuits.

4. A cooling device according to claim 1, wherein water is employed as said coolant.

* * * * *